US009792885B1

(12) United States Patent
Cerezo de Osma

(10) Patent No.: US 9,792,885 B1
(45) Date of Patent: Oct. 17, 2017

(54) PIANO PEDAL OPERATING DEVICE FOR PEOPLE WITH DISABILITIES

(71) Applicant: Javier Cerezo de Osma, Madrid (ES)

(72) Inventor: Javier Cerezo de Osma, Madrid (ES)

( * ) Notice: Subject to any disclaimer, the term of this patent is extended or adjusted under 35 U.S.C. 154(b) by 0 days.

(21) Appl. No.: 15/366,337

(22) Filed: Dec. 1, 2016

(30) Foreign Application Priority Data

Jun. 1, 2016 (ES) ..... 201630707 U

(51) Int. Cl.
*G10C 3/26* (2006.01)
*G10C 3/16* (2006.01)

(52) U.S. Cl.
CPC ..... *G10C 3/26* (2013.01); *G10C 3/166* (2013.01)

(58) Field of Classification Search
CPC ..... G10C 3/26
See application file for complete search history.

(56) References Cited

U.S. PATENT DOCUMENTS 746,101 A * 12/1903 Kind ..... G10C 3/26 84/232
773,113 A * 10/1904 Asay ..... G10C 3/26 84/232
811,279 A * 1/1906 Creighton ..... G10C 3/26 84/232
841,015 A * 1/1907 Jacobson ..... G10C 3/26 84/232
877,603 A * 1/1908 Smith ..... G10C 3/26 84/220
992,522 A * 5/1911 Tyson ..... G10C 3/26 84/232
1,040,397 A * 10/1912 Paczynski ..... G10C 3/26 84/232
1,198,648 A * 9/1916 Mayher ..... G10C 3/26 84/232
1,242,633 A * 10/1917 Allen ..... G10C 3/26 84/232
1,252,446 A * 1/1918 Johnson ..... G10C 3/26 84/76
1,278,773 A * 9/1918 Smith ..... G10C 3/26 84/232
1,374,891 A * 4/1921 Kirk ..... G10C 3/26 74/562
1,412,870 A * 4/1922 Kirk ..... G10C 3/26 74/562

(Continued)

*Primary Examiner* — Robert W Horn
(74) *Attorney, Agent, or Firm* — Hayes Soloway PC

(57) ABSTRACT

Piano pedal operating device for people with disabilities, which allows for said operation by pressure exerted by the back of a user, wherein said piano comprises a first, vertical axis that may move longitudinally operated by means of the right pedal; a second, transverse axis joined to the first axis; strings operated by means of keys, designed to produce sounds; and dampers operated by the second axis, designed to prolong or extinguish the sounds produced by the strings. The device comprises a magnet attached to the first axis; an electro-permanent suction cup placed above the magnet, which it attracts in order to move the dampers away from the strings; a cable that conducts an electric current to the electro-permanent suction cup, in order to annul its attraction over the magnet, and thus bring the dampers closer to the piano strings; and a switch designed to cut the current flow.

2 Claims, 3 Drawing Sheets

(56) References Cited

U.S. PATENT DOCUMENTS 1,463,166 A * 7/1923 Kirk ..... G10C 3/26 74/562
1,526,999 A * 2/1925 Mizner ..... G10C 3/26 74/562
1,590,012 A * 6/1926 Doubetz ..... G10C 3/26 84/232
1,734,607 A * 11/1929 Stoddard ..... G10C 3/26 84/34
1,918,510 A * 7/1933 Woodall ..... G10C 3/26 84/232
2,030,929 A * 2/1936 Miyashita ..... G10C 3/26 84/232
2,213,800 A * 9/1940 Winans ..... G10C 3/26 84/232
2,245,314 A * 6/1941 Willis ..... G10C 3/26 84/232
2,454,969 A * 11/1948 Kaufman et al. ..... G10C 3/26 403/338
2,456,321 A * 12/1948 Rhodes ..... G10C 3/26 84/237
2,463,910 A * 3/1949 Rydstrom ..... G10C 3/26 84/232
2,468,977 A * 5/1949 Hobbs ..... G10C 3/26 74/512
2,504,056 A * 4/1950 Townsend ..... G10C 3/26 74/562
2,536,903 A * 1/1951 Benedict ..... G10C 3/26 84/230
3,365,994 A * 1/1968 Wehr ..... G10C 3/26 84/228
4,018,128 A * 4/1977 Megee ..... G10C 3/26 84/231
4,483,232 A * 11/1984 Pavick ..... G10C 3/26 84/232
4,656,914 A * 4/1987 Weisser ..... G10C 3/26 84/232
4,736,664 A * 4/1988 Hinsley ..... G10C 3/26 318/266

* cited by examiner

PIANO PEDAL OPERATING DEVICE FOR PEOPLE WITH DISABILITIES

OBJECT OF THE INVENTION

The present invention is framed within the technical field of piano accessories; more specifically, pedals or pedal mechanisms, and, in particular, it relates to an electromechanical operating device that makes it possible for people with lower-extremity motor disabilities to use a piano pedal.

BACKGROUND OF THE INVENTION

The percussion mechanism of a traditional piano is a set of levers designed to control the strokes from the mallet to the string, thereby allowing a pianist to modulate the instrument's expression of sound. Said mechanism comprises four main parts; namely, the mallet or hammer, the key, the wippen and the damper.

The basic operation of traditional pianos begins with the pianist pressing the key; this activates a lever that moves a hammer which, in turn, strikes the corresponding key whilst simultaneously raising the damper, such that the string vibrates until the key is released; at this time, the damper falls onto the string, causing it to stop vibrating and producing sound.

Traditional pianos may be divided into two major categories: grand pianos, which have large dimensions, and wherein the strings and the resonance box are in a horizontal position, and upright pianos, which are characterised in that the strings, the mallets and the resonance box are in a vertical position, perpendicular to the floor. Due to their smaller dimensions, the latter are the most habitual in household environments.

In regards to the piano pedals, their function is to modify or alter the sound produced and, to this end, they are operated with the tips of the toes without raising the heel from the floor. In all types of pianos, there are three different pedals: the left, the middle and the right pedal.

The function of the left pedal, also occasionally called una corda pedal, is to bring the percussion hammers closer to the string, in order to attenuate the intensity of the sound obtained when striking upright pianos. In general, it is only used for some specific passages that require minimum intensity. The middle pedal, which in upright pianos has a muffler function, interposes a felt curtain between the hammers and the strings, which considerably reduces the intensity of the sound obtained.

Finally, the right pedal or sustain pedal causes the dampers of all the strings to rise, thereby producing a longer duration of the sound obtained from striking the string, as well as greater richness of sonority upon activating the harmonics; on the contrary, when the pedal is no longer operated with the foot, the dampers once again fall onto the strings, thereby extinguishing the sound. It is the most commonly used pedal in piano playing.

On the other hand, paraplegia is a disease, congenital or originating from a spinal cord injury, which causes the lower half of the body to be paralysed and without functionality.

DESCRIPTION OF THE INVENTION

The object of the invention is an electromechanical piano pedal operating device for people with disabilities, which allows for said operation without the need to use the lower extremities, with minimal repercussions on the musical and aesthetic quality of the performance. The device is especially conceived for the right pedal, which is the one most commonly used during piano execution, and for upright pianos, since they are the most widespread.

To this end, an electromechanical device composed of an electromagnet and a magnet, with the corresponding power supply, is inserted inside the piano's resonance box. The magnet is attached to the upper end of a first axis, which, in general, is mechanically operated by the pressure exerted by the foot on the right pedal. In turn, the first axis is attached to a second axis, to which the piano's plurality of dampers are joined, such that operation of the first axis causes the movement of the dampers on their respective strings.

Immediately above the magnet, there is an electromagnet, selected from the group of single-acting solenoids, which are activated when supplied with a current flow, thereby creating a magnetic field around them, and deactivated when current does not circulate. In a preferred embodiment, the electromagnet is an electro-permanent suction cup.

The attraction and the retention of the ferromagnetic material are obtained by means of permanent magnets incorporated into the suction cup, which does not present any mobile frames; it is of the open magnetic circuit type. In addition to the permanent magnets, a coil is incorporated which, when excited, annuls a part of the magnet's magnetic field, thereby allowing for release of the part.

The attraction and the retention of the magnetic parts in electro-permanent suction cups are obtained by means of permanent magnets incorporated into the suction cup, which further incorporates coils that, when excited as a result of a flow of electric current, annul a part of the magnet's magnetic field, thereby allowing for release of the part to which the magnet is attached. When the excitation ceases, the suction cup recovers its initial force. The main advantage of this type of suction cups is that they prevent the potential detachment of the sustained charge due to the supply voltage failures which normal electromagnetic suction cups may suffer.

The electro-permanent suction cup inserted in the piano is connected to an electrical outlet by means of a cable. At some point in the cable between the electrical outlet and its connection to the suction cup, a switch is interposed which may be operated by a person by exerting pressure. Since the users to which the invention is addressed have their lower extremities immobilised, said operation may be exerted by one of the functional parts of their body.

The switch is pushed by means of the pressure exerted by the movements of the person's trunk which are naturally produced during piano playing, preferably the scapula area of the back; to this end, said switch is attached to the back of a bench of the type habitually used to sit in front of a piano.

If the switch is not pushed, no current circulates; consequently, the magnetic suction cup is activated and attracts the magnet, keeping the first axis in a raised position, such that the dampers are away from the piano strings. On the contrary, if the performers lean back slightly and push the switch with their back, an electric current circulates which destroys the magnetic field created by the magnetic suction cup, causing the latter to drop the magnet and, consequently, the axis, and bringing the dampers closer to the strings in order to extinguish the sound that they produce.

DESCRIPTION OF THE DRAWINGS

In order to supplement the description being made, and to contribute to a better understanding of the characteristics of the invention, according to a preferred embodiment thereof, a set of drawings is attached to said description as an integral part thereof, where the following is represented for illustrative, non-limiting purposes.

PREFERRED EMBODIMENT OF THE INVENTION

With the aid of the aforementioned figures, below we provide a detailed explanation of a preferred embodiment of the object of the present invention.

Figure 1:
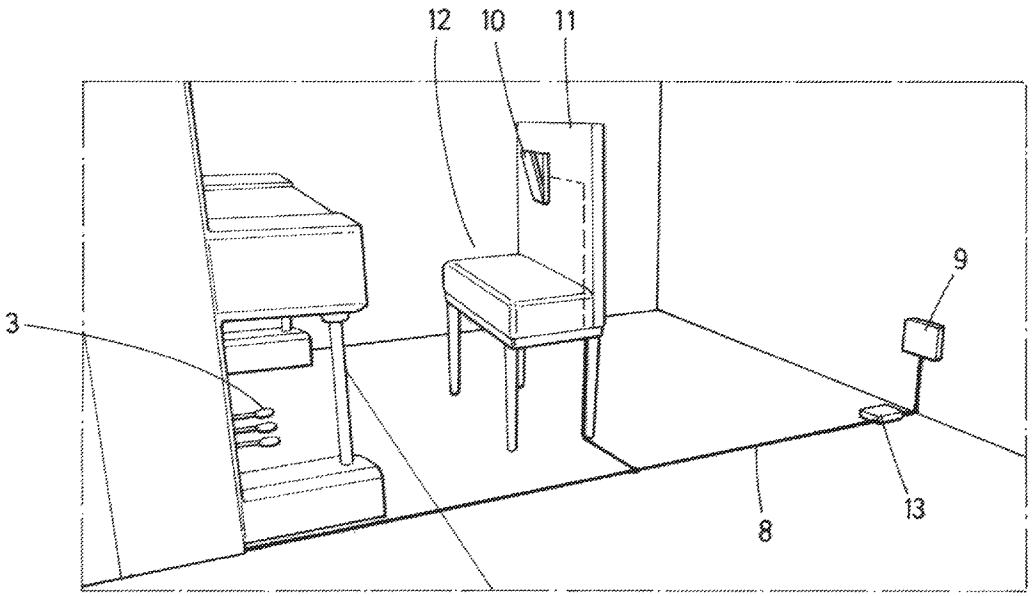
FIG. 1.—Shows a schematic perspective view of the device, wherein its main constituent elements may be observed.
Figure 2:
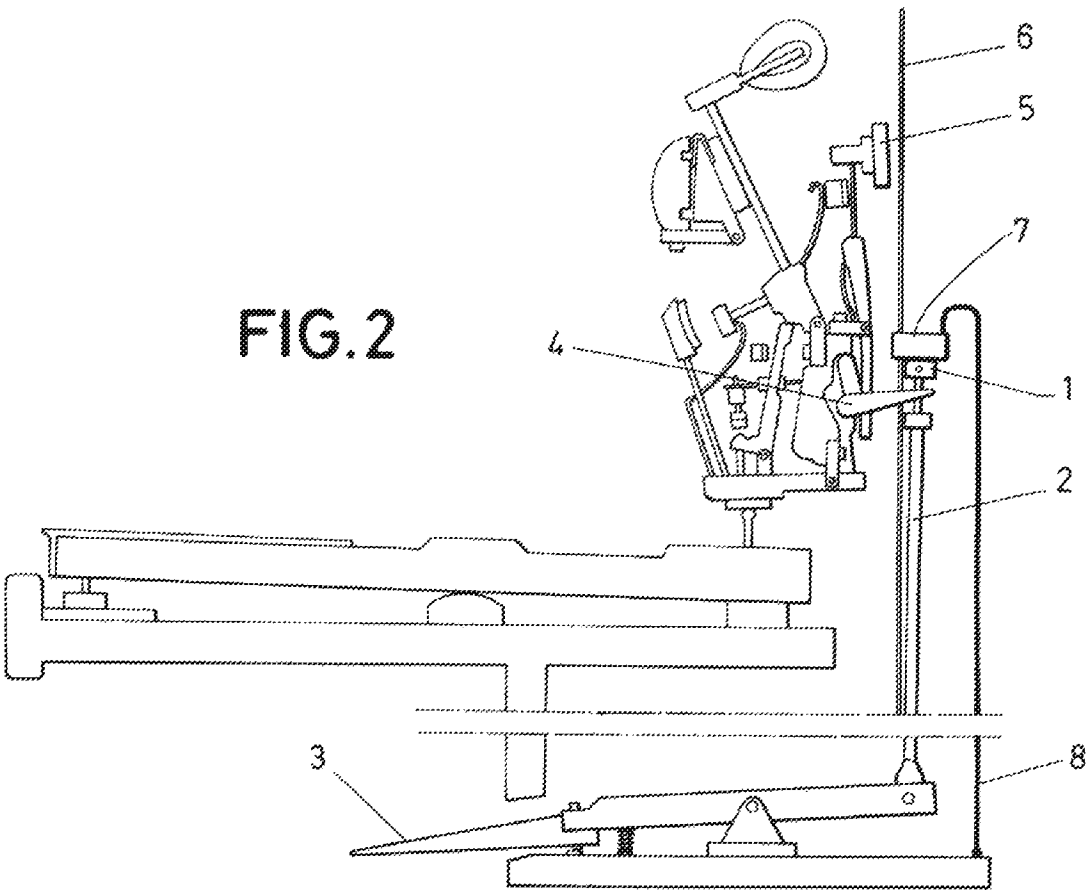
FIG. 2.—Shows a schematic view of a cross-section of the piano's resonance box, which shows the electromechanical device in the rest position.
Figure 3:
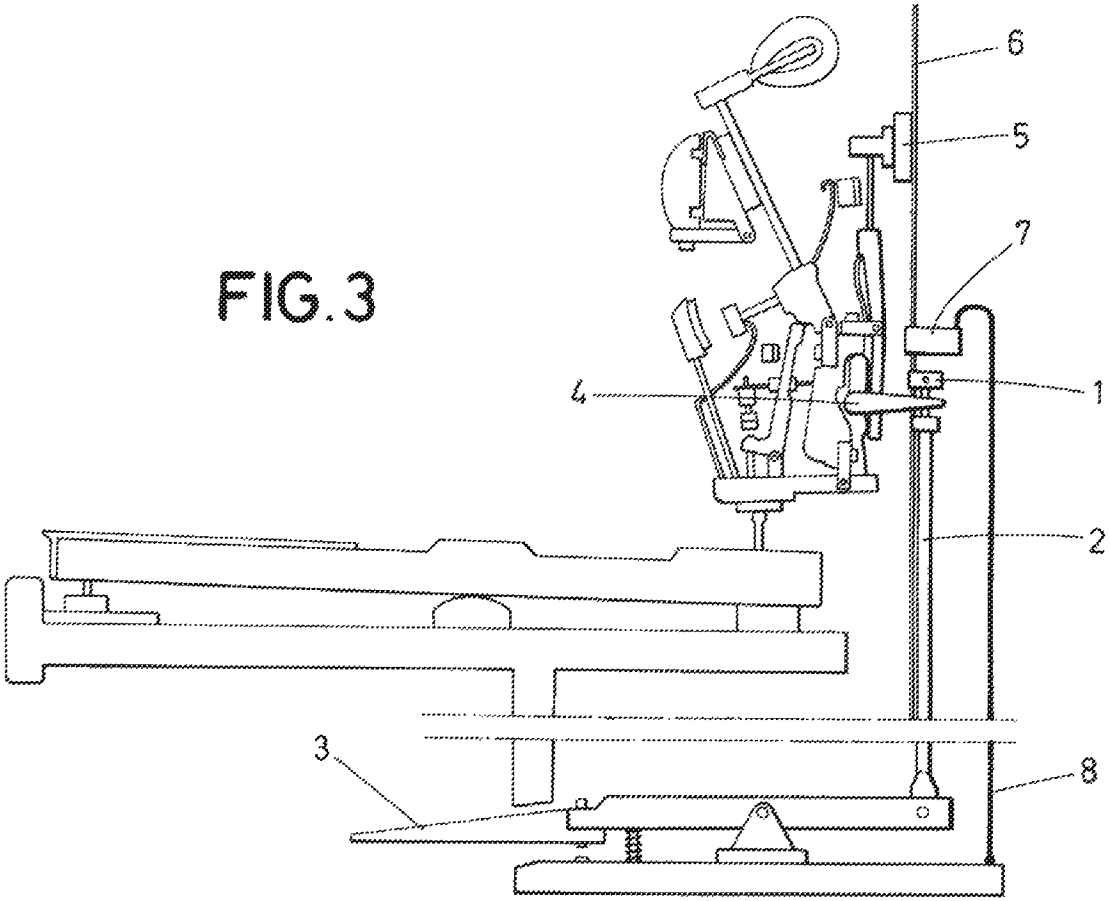
FIG. 3.—Shows a schematic view of a cross-section of the piano's resonance box, which shows the electromechanical device in the active position.

The piano pedal operating device for people with disabilities being described, schematically shown in FIG. 1, is composed of an electromechanical device inserted inside a piano's resonance box, which comprises, in the first place, a magnet (1) that is removably attached to the upper end of a first axis (2), usually operated by the right pedal (3) of the piano when it is pressed by a person's foot. In turn, the first axis (2) is attached to a second axis (4), which operates the piano's dampers (5), as shown in FIGS. 2 and 3, in order to mute the sound of the strings (6).

An electro-permanent suction cup (7) is placed immediately above the magnet (1). The electro-permanent suction cup (7) is connected to a cable (8) that conducts a flow of electric current from an electrical outlet (9) to said electro-permanent suction cup (7) located inside the piano.

The circulation of electric current through the cable (8) is regulated by interposing a switch (10) that is located on the back (11) of a bench (12) used by the person during the performance. Said switch (10) is designed to be operated by means of a slight pressure exerted by the person when moving the dorsal part of his/her back, generally the scapula area.

In those cases wherein the selected electro-permanent suction cup (7) operates with direct current, a rectifier (13) may be incorporated in order to transform the alternating current originating from the electrical outlet (9) into a direct current suitable to operate said electro-permanent suction cup (7).

Moreover, a transformer, not represented in the attached figures, may be interposed, in order to convert the voltage of the current originating from the electrical outlet (9) into a voltage suitable for correct operation of the device.

When the device is in a rest position, as schematically shown in FIG. 2, the switch (10) is not operated and this prevents the flow of electric current through the cable (8) towards the electro-permanent suction cup (7), which therefore attracts the magnet (1) as a result of its own electromagnetic field. Said position of the magnet (1), which is magnetically attached to the electro-permanent suction cup (7), entails an upper longitudinal movement of the first axis (2) and the second axis (4) whereto it is attached, such that the dampers (5) are away from the strings (6), thereby causing a longer duration of the sound obtained from striking the strings (6) upon pressing the piano keys. Therefore, the rest position of the device thus described substitutes for the effect caused by pressing the right pedal (3).

When the device is in an active position, as schematically shown in FIG. 3, the switch (10) is operated and this allows for the flow of electric current through the cable (8) towards the electro-permanent suction cup (7). Said flow produces an excitation in an internal coil of said electro-permanent suction cup (7), which annuls a large part of its own electromagnetic field, with the consequent interruption of the magnet's (1) attraction; as a result, due to the effect of gravity, the latter moves longitudinally towards a lower position. Said movement of the magnet (1) causes the first axis (2), to whose upper end it is removably attached, to move in the same direction, and, in turn, causes the second axis (4) to move, such that the dampers (5) come closer to the strings (6) until they come in contact with them, thereby producing an extinction of the sound obtained. Therefore, the active position of the device thus described substitutes for the effect caused by non-operation of the right pedal (3).

The invention claimed is:

1. Piano pedal operating device for people with disabilities, wherein the piano is equipped with keys, a right pedal and a resonance box that contains the following:

- a first, vertical axis that may move longitudinally and, in general, is operated by means of the right pedal,
- a second, transverse axis, which is jointly attached to the first axis,
- a plurality of strings operated by the keys, designed to produce a plurality of sounds, and
- a plurality of dampers, which act on the plurality of strings by means of the second axis, in order to prolong or extinguish the sounds produced by the strings, wherein said device comprises:
- a magnet which may be attached to an upper end of the first axis,
- an electro-permanent suction cup placed above the magnet, which it attracts to itself as a result of its own electromagnetic field, in order to move the dampers away from the strings,
- a cable designed to conduct a flow of electric current from an electrical outlet to the electro-permanent suction cup, in order to annul its own electromagnetic field and its attraction over the magnet, thereby bringing the dampers closer to the piano strings, and
- a switch, which allows for or prevents the flow of electric current circulating through the cable, designed to be placed on the back of a bench, in order to be operated by the pressure exerted by a person's back.

2. Piano pedal operating device for people with disabilities according to claim 1, wherein the electro-permanent suction cup is supplied by a flow of direct current.

* * * * *